United States Patent [19]

Child

[11] 3,979,314

[45] Sept. 7, 1976

[54] DETERGENT COMPOSITIONS

[75] Inventor: Terence Frederick Child, Wirral, England

[73] Assignee: Lever Brothers Company, New York, N.Y.

[22] Filed: Aug. 14, 1974

[21] Appl. No.: 497,425

[30] Foreign Application Priority Data

Aug. 15, 1973 United Kingdom ..... 38646/73

[52] U.S. Cl. ..... 252/140; 8/137; 252/135; 252/160; 252/550; 252/558; 252/532; 252/533; 252/DIG. 15

[51] Int. Cl.[2] ..... C11D 3/12

[58] Field of Search ..... 252/140, 160, 550, 558, 252/DIG. 15, 532, 533, 135; 8/137

[56] References Cited

UNITED STATES PATENTS 3,716,488 2/1973 Rolsky et al. ..... 252/137 X

*Primary Examiner*—Mayer Weinblatt

*Attorney, Agent, or Firm*—James J. Farrell; Kenneth F. Dusyn; Melvin H. Kurtz

[57] ABSTRACT

Finely divided calcium carbonate used in a detergent composition containing sodium carbonate as a detergency builder, is treated before drying with a water-insoluble dispersing aid. This decreases the tendency of the calcium carbonate particles to aggregate and be deposited on fabrics during washing.

13 Claims, No Drawings

DETERGENT COMPOSITIONS

The present invention concerns the use of finely divided calcium carbonate which is prepared by precipitation from aqueous solution, as an ingredient in detergent compositions.

In the specification of our copending patent application Ser. No. 386,827, we have described detergent compositions which contain an alkali metal carbonate detergency builder together with finely divided calcium carbonate, in addition to a detergent active compound or compounds. The presence of the calcium carbonate decreases the tendency of the compositions to form inorganic deposits on washed fabrics, which is normally a disadvantage of the use of alkali metal carbonate detergency builders. This is apparently because the precipitated calcium carbonate is deposites on the added calcium carbonate instead of on the fabrics or washing machine surfaces. Moreover, by encouraging the calcium hardness in the wash water to be removed from solution in this way, the detergencies of the compositions are improved. The added calcium carbonate also appears to act as a scavenger for the calcium carbonate precipitation inhibitors which we have found to be commonly present in wash liquors; this scavenging facilitates the precipitation process and further increases the effect of the added calcium carbonate.

For the achievement of the benefits of having the finely divided calcium carbonate present in the detergent compositions, it is necessary that the calcium carbonate should have a high surface area, that is at least about 5 square meters per gram ($m^2/g$), generally at least about 10 $m^2/g$ and preferably at least 20 $m^2/g$. The particularly preferred calcium carbonate has a surface area of from about 30 $m^2/g$ to about 100 $m^2/g$, especially about 50 to about 80 $m^2/g$. Calcium carbonate with surface areas in excess of about 100 $m^2/g$ could be used if such materials are economically available, but it appears to be unlikely that any higher surface areas will be achievable commercially and this may in any case be undesirable for other reasons, for example especially small particles, i.e. with very high surface areas, may have a tendency to be absorbed onto fabrics during the washing process and there may be dust problems.

It is necessary to use an amount of calcium carbonate in the compositions of at least about 5%, and preferably at least about 10% up to about 60%, more preferably about 10 to about 40% by weight of the compositions.

It is of course important to prevent the added calcium carbonate from itself being deposited on the fabric. Normally, this can be achieved by thoroughly dispersing the calcium carbonate in the wash liquor together with the other detergent ingredients before the fabrics are added. However, during mis-use of the detergent compositions, especially if the compositions are added to the wash liquors after the fabrics, the particles of the compositions can become trapped in the folds of the fabrics, and sometimes there can be found to be appreciable deposition of the added calcium carbonate on the fabrics.

We have now found that calcium carbonate which has been treated before it has been dried, either during or after its manufacture by chemical precipitation, by the addition of certain very finely-divided water-insoluble inorganic materials, has a decreased tendency for the calcium carbonate particles to aggregate, and subsequently be deposited on fabrics during the washing process.

Accordingly, the present invention provides a detergent composition comprising an alkali metal carbonate detergency builder and finely-divided calcium carbonate which has been treated with a water-insoluble inorganic dispersing aid as defined hereinafter. Early treatment of the calcium carbonate with the dispersing aid is generally preferable, especially where the calcium carbonate is subjected to any treatment between its formation by chemical precipitation and eventual drying which would encourage aggregation, for example any steps to increase substantially the concentration of the calcium carbonate in the reaction product. However, provided the calcium carbonate is not previously dried and thereby aggregated unduly, it may be satisfactory to delay its treatment with the dispersing aid until during detergent slurry making, as aggregation is promoted particularly in the spray drying process to form a detergent powder.

The invention includes processes for making detergent compositions in powder form containing finely-divided calcium carbonate according to the invention, wherein the calcium carbonate is treated with the dispersing aid in aqueous suspension prior to detergent slurry-making or wherein the calcium carbonate and the dispersing aid are separately added to the detergent slurry, prior to spray-drying. The slurry making and spray drying steps in the process of the present invention may be done in conventional equipment for this purpose, for example in crutcher, paddle or turbomixers and spray drying towers. Normal temperatures are used for these operations, for example about 40°–100°C, preferably about 70°–90°C, for the slurry making and about 250°–450°C for the drying gas inlet in the spray drying process, with higher temperatures in this range being preferred for economic reasons.

The calcium carbonate used may take any crystalline form, but calcite is preferred, as aragonite and vaterite appear to be more difficult to prepare with high surface areas, and it appears that calcite is a little less soluble than aragonite or vaterite at most usual wash temperatures. When any aragonite or vaterite is used it is generally in admixture with calcite. Finely divided calcium carbonate can be prepared conveniently by precipitation proceses, for example by passing carbon dioxide into a suspension of calcium hydroxide. Other chemical precipitation reactions may be employed to produce the calcium carbonate, especially the reaction between any relatively soluble calcium salt and any soluble carbonate salt, for example by reaction between calcium sulphate or calcium hydroxide and sodium carbonate, but these reactions form aqueous slurries containing undesirable dissolved salts, i.e. sodium sulphate and sodium hydroxide in the examples mentioned, which means that the calcium carbonate has to be filtered from the reaction product before its use unless the dissolved salts can be tolerated in the detergent compositions.

Suitable forms of calcium carbonate, especially calcite, are commercially available. The calcium carbonate is preferably in substantially pure form, but this is not essential and the calcium carbonate used may contain minor amounts of other cations with or without other anions or water molecules.

As an indication of the general relationship between particle size and surface area, we have found that calcite with a surface area of about 50 $m^2/g$ has an average primary crystal size (diameter) of about 250 Angstrom (A), whilst if the primary crystal size is decreased to about 150 A the surface area increases to about 80 $m^2/g$. In practice some aggregation takes place to form larger particles, despite the use of the dispersing aids according to this invention. But it is desirable that the aggregated particle size of the calcium carbonate should be fairly uniform, and in particular that there should be no appreciable quantity of large particles which would easily get trapped in the fabrics being washed or cause abrasive damage to washing machine parts.

Surface areas of the finely divided calcium carbonate are determined by the standard Brunauer, Emmet and Teller (BET) method, using an AREA-meter made by Strohlein & Co., and operated according to the suppliers' instruction manual. The procedure for degassing the samples under investigation is usually left to the operator, but we have found that a degassing procedure in which the samples are heated for 2 hours at 175°C under a stream of dry nitrogen is effective to give repeatable results.

It should be mentioned that the calcium carbonate may be adsorbed onto a substrate when it is formed, in which case it may not be possible to measure accurately by the BET method the surface area of the calcium carbonate alone. The effective surface areas can then be deduced by checking the effectiveness of the calcium carbonate and relating this to the effectiveness of calcium carbonates of known surface areas. Alternatively, it may be possible to use electron microscopy to determine the average particle size, from which an indication of surface area might be obtained, but this should be checked by determining the effectiveness of the calcium carbonate in use.

The calcium carbonate is preferably prepared in the form of a concentrated aqueous suspension or slurry, which is used directly in the preparation of detergent compositions. Thus, the calcium carbonate is generally present to the extent of at least about 5%, especially at least about 10% by weight in the aqueous suspension and more preferably from about 20% to 40% by weight. At high calcium carbonate levels the product is a viscous slurry which gives handling problems, so there is a practical maximum content of calcium carbonate of about 50% by weight. However, this depends on the type of calcium carbonate used as the higher surface area calcium carbonates have a greater slurry thickening effect then relatively coarse calcium carbonates, and on the effect on slurry viscosity of any additives which may be present, for example sodium toluene sulphonate which tends to decrease slurry viscosity. It will be appreciated that the less water that is present in the slurry gives less water to evaporate subsequently in the preparation of a particulate detergent composition, to economic advantage.

The dispersing aids are very finely divided water insoluble materials which appear to coat the calcium carbonate particles to hinder aggregation as described above. We have found in particular that montmorillonite clays of either natural origin, e.g. bentonite, or synthetically manufactured clays of the same type are effective dispersing aids, (bentonite may also be known as taylorite or Denver clay). However, it may be noted that the efficacy of a material as a dispersing aid cannot positively be predicted, and it is found that otherwise similar compounds may often act quite differently in this respect. It apprears that the dispersing properties depend mainly on the particle size of the material which should apparently be smaller than the calcium carbonate particle, and the electric charge of the material which effects its attraction to the calcium carbonate particles. Montmorillonite clays such as bentonite are characterised by a very small particle size and a relatively high negative particle charge and are particularly good dispersing aids, whilst illite for example which is somewhat similar in chemical structure also has small particles but a lower particle charge and is not effective. It will be appreciated that when the calcium carbonate is intended for use in a detergent composition, the dispersing aid should not be toxic or highly coloured, or otherwise unsuitable for use in a detergent composition.

The test to ascertain whether or not a material is a dispersing aid is as follows:

DISPERSING AID TEST

An aqueous suspension of calcite (Calofort U50 supplied by J. & E. Sturge Limited of Birmingham, England having a nominal surface area of about 50 $m^2/g$ is prepared containing 0.5% by weight of the calcite. To ensure thorough dispersion of the calcite the suspension is agitated with an ultrasonic probe and then an amount of the material under test is thoroughly admixed with the slurry. The treated calcite suspension is then filtered through fine filter paper to give a cake of calcite which is oven-dried, after which the dried cake is manually ground in a mortar and pestle to form a fine powder.

The dried treated calcite is then resuspended in water containing 12° (French) Ca hardness and enough sodium carbonate is then added in aqueous solution to precipitate the hardness ions in simulation of a detergency building situation, the final concentration of calcite and sodium carbonate being 0.12% and 0.105%, respectively, in 1 liter of water. The resultant suspension is then agitated in a Terg-O-Tometer under repeatable conditions (100 rpm) at 60°C for 10 minutes, and the solution is then filtered under standard conditions of suction through a circle of black cotton twill closeweave cloth in a Buchner funnel. The cloth and any sediment are then allowed to dry in air at ambient temperature and the amount of deposit is then graded on a 5-point whiteness scale as follows:

| | |
|---|---|
| 0 | no deposit |
| 1 | trace of deposit |
| 2 | light deposit |
| 3 | moderate deposit |
| 4 | heavy deposit |
| 5 | very heavy deposit |

In the absence of an effective dispersing aid in this test the white deposit on the cloth has a grading of 5, showing that during the drying process there is considerable formation of aggregates of calcite particles, which do not pass through the filter cloth. Any material which in this test produces a lower cloth grading is a dispersing aid at the level used, but the preferred materials give cloth deposit gradings of 2 or 3; in this severe test results of 0 to 1 are not normally achievable, but dispersing aids giving gradings of 2 or 3 are quite effective in practice.

In may be noted that the test could be done with another type of calcium carbonate, especially calcite, provided it has a very high surface area and that the same calcite is used throughout any series of tests, but Calofort U50 calcite has been found to be particularly good. Use of a single bulk supply of calcite has been found to be more reliable, and more convenient, than a test procedure in which the calcite is actually formed by precipitation. The ultrasonic agitation of the calcite dispersions ensures that the calcite particles are not aggregated before the dispersing aid under test is added, which can be confirmed by passing the initial calcite dispersion through the black filter cloth when no deposit should be found.

Using the above dispersing aid test the following results have been found with a variety of finely divided inorganic materials.

| Test No. | Material | Amount[6] | Black Cloth Grade |
|---|---|---|---|
| 1 | Bentonite clay[1](BDH) | 0.025 | 3 |
| 2 | " | 0.04 | 3 |
| 3 | " | 0.08 | 2 |
| 4 | Hectorite[1] | 0.025 | 4 |
| 5 | Laponite[2] | 0.025 | 4 |
| 6 | Kimberlite[3] | 0.075 | 4 |
| 7 | Fuller's Earth (BDH) | 0.025 | 5 |
| 8 | Lucilite[4] | 0.025 | 5 |
| 9 | Attagel[5] | 0.05 | 5 |
| 10 | Fine vermiculite | 0.07 | 5 |

[1]Natural montmorillonite clays. The formula of montmorillonite clay is based on $(OH)_4Al_4Si_8O_{20}.nH_2O$, whilst in Hectorite, 2 $Al^{3+}$ is replaced by 3 $Mg^{2+}$ with some Li/Mg substitution.
[2]Synthetic montmorillonite-type material made by Laporte Industries having a structure and composition similar to Hectorite.
[3]A saponite clay found near Kimberly, South Africa. Saponite clays are of montmorillonite type with large replacement of $2Al^{3+}$ by 3 $Mg^{2+}$ and a little $Al^{3+}$ by $Si^{4+}$.
[4]Micronised silica
[5]A synthetic attapulgite
[6]% amount per liter (0.025 is equivalent to 5% of the amount of calcite).

It can be seen that the montmorillonite clays, and especially bentonite, give good results at low levels on the calcite. The other materials in tests 7 to 10 are not effective dispersing aids.

The amount of the dispersing aids used can be generally from about 1% up to about 50% by weight of the calcium carbonate, but is preferably from about 5–25% by weight of the calcium carbonate. It will be appreciated that the more effective dispersing aids are generally used at the lower levels and this is generally preferred, for example a level of about 10% on the weight of the calcium carbonate is most effective for the use of bentonite as the dispersing aid.

As mentioned above, it is necessary to treat the calcium carbonate with the dispersing aid when in aqueous dispersion in order for the treatment to be effective. Besides the effect of the finely-divided calcium carbonate on the viscosity of the aqueous dispersions, some dispersing aids themselves have appeciable thickening effects, which limit the concentrations of the aqueous dispersions which can be used. For example bentonite forms a thixotropic aqueous dispersion when used at relatively low concentrations, and a 15% by weight aqueous dispersion is a viscous gel. For this reason the bentonite should be used in more dilute aqueous dispersion, for example about 5% by weight, which makes it most convenient to treat the calcium carbonate when it is freshly prepared in dilute suspension, and before it is dewatered to give a more concentrated slurry for transportation in that form or for further drying to powder form, in preparation for subsequent incorporation into detergent compositions according to the invention.

The treatment of finely-divided calcium carbonate, especially finely-ground calcite, has been proposed hitherto particularly to facilitate the incorporation of the calcite into products such as rubber. In this case the calcite may be treated to provide a hydrophobic surface, for example by using organic materials, or the calcite may be treated with so-called protective colloids to inhibit growth of the calcite particles. Most of the materials which have been proposed hitherto for such treatment of calcium carbonate are not effective as dispersing aids for the purpose of the present invention. It may also be noted that hitherto the calcium carbonate has been treated in dry form. However, this we find to be less effective for inhibiting aggregation than the treatment of the calcite carbonate with dispersing aids before the calcium carbonate has been dried, in accordance with the present invention.

In the preparation of detergent compositions, sodium carbonate, detergent active compounds and any other desired ingredients are conveniently admixed, preferably under vigorous agitation, with the calcium carbonate suspensions to give detergent slurries which can be spray dried to form detergent powders, using conventional techniques.

The alkali metal carbonate used is preferably sodium or potassium carbonate or a mixture thereof, for reasons of cost and efficiency. The carbonate salt is preferably fully neutralised, but it may be partially neutralised, for example a sesquicarbonate may be used in partial replacement of the normal carbonate salt; the partial salts are less alkaline and therefore less efficient. The amount of the alkali metal carbonate in the detergent composition can be varied widely, but the amount should be at least about 10% by weight, preferably from about 20% to 60% by weight, though an amount of up to about 75% could possibly be used if desired in special products. The amount of the alkali metal carbonate is determined on an anhydrous basis, though the salts may be hydrated either before or when incorporated into the detergent composition. It should be mentioned that within the preferred range the higher levels tend to be required under conditions of use at low product concentrations, as is commonly the practice in North America, and the converse applies under conditions of use at higher product concentrations, as tends to occur in Europe. It should be noted that it may also be desirable to limit the carbonate content to a lower level within the range mentioned, so as to decrease the risk of internal damage following any accidental ingestion, for example by children.

As mentioned earlier, the amount of calcium carbonate used in the compositions should be from about 5 up to about 60% by weight of the compositions. Within this broad range, the lower levels of calcium carbonate may be satisfactory under certain conditions of use and with particularly effective calcium carbonates. However, with less effective calcium carbonates, and especially under conditions of use at low product concentrations, as for example under typical North American washing conditions, it is preferred to use higher levels of calcium carbonate within the preferred range mentioned. The surface area of the calcium carbonate very markedly affects its properties, with high surface area materials being more effective, so that lower amounts of such materials can be used to good effect in comparison with calcium carbonate of low surface area.

In addition to the essential alkali metal carbonate and finely divided calcium carbonate treated with a dispersing aid as described above, it is necessary to include in the detergent compositions of the present invention an amount of a synthetic nonionic, anionic, amphoteric or zwitterionic detergent active compound, or a mixture thereof. It is desirable that the detergent active compound or compounds used should not form during use at normal product concentration in hard water excessively water-insoluble calcium salts; this ensures that the detergent active compound is not completely precipitated as its calcium salt instead of calcium carbonate being precipitated. Some degree of precipitation of the detergent active compound or mixture of compounds in the form of the calcium salts may be tolerated, provided that after allowing for the subsequent redissolution of any of the calcium salt during the washing process, the amount of any more permanent precipitate is minor and that an effective amount of detergent active compound is left in solution. Thus, the detergent active compound should not be wholly soap, which if added with the sodium carbonate and calcium carbonate wound tend to be precipitated too rapidly in the form of its calcium soap, and calcium tallow soap is so insoluble that it does not revert subsequently to the sodium soap, because the calcium soap is less soluble than the calcium carbonate (as measured by the free $Ca^{++}$ concentration). However, a little soap may be present with other detergent active compounds, as for example in binary or ternary active low sudsing products, where the presence of the soap influences the lather properties, though it does not act as a detergent active compound after its precipitation as the calcium soap.

Many suitable synthetic detergent active compounds are commercial available and they are fully described in the literature, for example in "Surface Active Agents and Detergents" Volumes 1 and 2, by Schwartz, Perry & Berch. Preferred detergent active compounds which can be used include nonionic detergent active compounds which are not calcium sensitive, and anionic detergent active compounds which either form water-soluble calcium salts, as for example with certain alkyl ether sulphates, or which tend to form only slightly insoluble calcium salts when used alone but which are used in conjunction with other solubilising compounds, especially other detergent active compounds, for example mixtures of certain alkyl benzene sulphonates with nonionic detergent active compounds, and some mixed olefin sulphonates of which some of the olefin sulphonate constituents appear to act as solubilising agents for the other less-soluble constituents.

It may be noted that some of the detergent active compounds which are included in the compositions of the invention also have calcium carbonate dispersing properties. Nonionic detergent active compounds tend to be less effective in this respect than many anionic detergent active compounds, so the benefit of the present invention tends generally to be more apparent with the former.

Specific nonionic detergent active compounds which can be used in the compositions of the invention include ethoxylated fatty alcohols, preferably linear primary or secondary monohydric alcohols with $C_{10}$-$C_{18}$, preferably $C_{10}$-$C_{15}$, alkyl groups and about 5–15, preferably 7–12, ethylene oxide (EO) units per molecule, and ethoxylated alkylphenols with $C_8$-$C_{16}$ alkyl groups, preferably $C_8$-$C_9$ alkyl groups, and from about 4–12 EO units per molecule. The nonionic compounds are often used in admixture with minor amounts of other detergent active compounds, especially anionic compounds, to modify the lather characteristics and powder properties; it may also be noted that low levels (about 1–10%) of sodium tallow soap or other long chain (at least $C_{16}$) anionic compounds which do form insoluble calcium salts have been found in particular to be beneficial with nonionic detergent active compounds, as they tend to decrease calcium carbonate deposition onto cotton fabrics, and also give some fabric softening effect, whereas with nonionic compounds alone there can be higher deposition than desirable with some fabric harshening. Mixtures of nonionic compounds with amine oxides can also give good results.

The preferred anionic detergent active compounds which form either soluble or only slightly insoluble calcium salts, are alkyl ($C_{10}$-$C_{18}$, preferably about $C_{14}$) sulphates and alkyl ($C_{10}$-$C_{18}$) ether (1-10 EO) sulphates, particularly those with $C_{10}$-$C_{15}$ alkyl groups and 1–7 EO and tallow alcohol 1–5 EO sulphates, and olefin sulphonate detergent active compounds, which latter term is herein used to mean the mixture of anionic detergent active compounds obtained when the products of the sulphonation of olefins are neutralised and hydrolised. Instead of hydrolysis the initial reaction product may be reacted with a lower alcohol before neutralisation to form a proportion of an alkoxy alkane sulphonate in admixture with the residue of the olefin sulphonate product. The olefins are used preferably linear $C_{12}$-$C_{20}$ alpha-olefins, particularly $C_{14}$-$C_{16}$ alpha-olefins, produced for example by the "cracked wax" process or by the "Ziegler" process, but localised internal, random or so-called vinylidene olefins may alternatively be used. The anionic detergent active compounds are used in the form of the alkali metal, ammonium or substituted ammonium salts, preferably the sodium salts.

Other detergent active compounds which do not form insoluble calcium salts, but which are of less commercial interest, include salts of esters of alpha-sulphonates ($C_{10}$-$C_{20}$) fatty acids with $C_1$-$C_{10}$ alcohols, preferably $C_1$-$C_3$ alcohols; salts of 2-acyloxy-alkane-1-sulphonic acids ($C_{10}$-$C_{22}$, preferably $C_{12}$-$C_{16}$ alkyl group and the $C_1$-$C_8$ ester group); trialkyl amine oxides having a $C_{10}$-$C_{22}$ alkyl group, and two $C_1$-$C_4$ alkyl or $C_2$-$C_3$ hydroxyalkyl groups; and dialkyl sulphoxides having a $C_{10}$-$C_{22}$ alkyl group and a $C_1$-$C_4$ alkyl or $C_2$-$C_3$ hydroxyalkyl group, together with detergent active betaines and sulphobetaines, for example lauryl ammonio propane sulphonate. Cationic detergent compounds such as quaternary ammonium compounds may also be used in minor amounts, but they are of much less commercial interest.

As stated earlier, mixtures of some detergent active compounds can give particularly good results. Specifically, some alkyl benzene sulphonates (which when used alone tend to form slightly insoluble calcium salts) can be used with minor amounts of certain solubilising compounds, such as nonionic, alkyl sulphate or alkyl ether sulphate detergent active compounds, to give good detergent properties and be relatively economical. The ratio by weight of such solubilising compounds to the alkyl benzene sulphonate is preferably from about 1:1 to 1:10, especially about 1:2 to 1:8. It should, however, be added that linear secondary ($C_{11}$-$C_{15}$) alkyl benzene sulphonates do have very good detergencies in this system and can be used alone, preferably in higher amounts which compensate for any tendency for initial precipitation of some of the detergent active compound, or with calcium carbonates of higher surface area which are more effective at lowering calcium ion concentration quickly. These alkyl benzene sulphonates also tend to be effective in lowering slurry viscosity whereas some others have the opposite effect. It may be noted that alkali metal tetra- and pentapropylene benzene sulphonates form more highly insoluble calcium salts and are therefore less satisfactory in this respect. The presence of calcium carbonate together with the alkali metal carbonate in the detergent compositions of the present invention enables lower calcium ion concentrations to be achieved in use than would be obtained with the latter alone, so that any calcium salts of alkyl benzene sulphonic acid which are precipitated initially may be redissolved during the subsequent washing process to liberate the active detergent compound, i.e. as the calcium ion concentration drops during the calcium carbonate precipitation.

The effective amount of the detergent active compound or compounds used in the compositions of the present invention is generally in the range of from about 5 to 40% by weight, preferably from about 10 to about 25% by weight of the composition. It may be noted that the choice of the detergent active compound or compounds used and their amounts appear to influence the precipitation of calcium carbonate, and hence can have a very marked effect both on detergency and on fabric deposition. The type of detergent active compounds used therefore influences the optimum level and type of added calcium carbonate, but in general it is best to use calcite of highest surface area, commensurate with cost considerations, at the minimum level to give satisfactory detergency and adequate inorganic deposition control, bearing in mind the necessity to leave sufficient "room" in the detergent compositions for other essential and optional ingredients.

In addition to the essential alkali metal carbonate and the calcium carbonate it is possible to include minor amounts of other detergency builders, provided that the total amount of the detergency builders does not exceed about 85% by weight, so as to leave room in the detergent compositions for other essential ingredients. One such detergency building ingredient is an alkali metal silicate, particularly sodium neutral, alkaline, meta- or orthosilicate. A low level of silicate, for example about 5–10% by weight, is usually advantageous in decreasing the corrosion of metal parts in fabric washing machines, and it may give processing benefits. for example levels of about 2% can decrease the viscosity of bentonite slurries, though higher levels can have the opposite effect. If higher levels of silicate are used up to a practical maximum of about 30%, for example from about 10% to 20% by weight, there can be a more noticeable improvement in detergency, which may permit some decrease in the alkali metal carbonate content. This effect appears to be particularly beneficial when the compositions are used in water with appreciable levels of magnesium hardness. The amount of silicate can also be used to some extent to control the pH of the composition, which is generally within the range of about 9–11, preferably 10–11 for an aqueous solution of the composition at the recommended concentration, a higher pH (i.e. over about pH 10.5) tends to be more efficient as regards detergency, but it may be less desirable for domestic safety. Sodium silicate is commonly supplied in concentrated aqueous solution, but the amounts are calculated on an anhydrous basis.

Other detergency builders can be present in minor amounts if desired, for example other so-called precipitant builders which form insoluble calcium salts, such as the sodium salts of long-chain alpha-sulphonated monocarboxylic acids, and alkali metal salts of alkyl and alkenyl succinic and malonic acids, and analogous compounds, some of which can have a desirable fabric softening effect, or some sequestrant builders, especially weak sequestrant builders such as sodium citrate. It should be noted, however, that some detergency builders, especially certain strong sequestrants such as sodium polyacrylate and other polymeric polycarboxylate builders, and certain organic precipitant builders such as sodium $\alpha$-sulpho tallow fatty acids, can have a marked detrimental effect on calcium carbonate precipitation; in the case of the latter organic precipitant builders which are also softening agents, it may be noted that they can be added in calcium salt form where they do not inhibit calcium carbonate precipitation and still retain softening properties. Also, sodium tripolyphosphate is a particularly strong calcium carbonate precipitation inhibitor, and it is desirable to exclude its presence from the compositions of the invention, quite apart from eutrophication considerations. In practice, due to plant contamination, its presence at low levels of, say, up to about 0.5% by weight may be unavoidable in the detergent compositions, but it is preferred to have a maximum level of about 0.05% phosphorus, which is equivalent to about 0.2% sodium tripolyphosphate.

The detergent compositions of the invention can also contain any of the conventional additives in the amounts in which such additives are normally employed in fabric washing detergent compositions. Examples of these additives include lather boosters such as alkanolamides, particularly the monoethanolamides derived from palm kernel and coconut fatty acids, lather depressants, anti-redeposition agents such as sodium carboxymethylcellulose, oxygen-releasing bleaching agents such as sodium perborate and sodium percarbonate, peracid bleach precursors, chlorine-releasing bleaching agents such as trichloroisocyanuric acid and alkali metal salts of dichloroisocyanuric acid, fabric softening agents, inorganic salts such as sodium sulphate, and, usually present in very minor amounts, fluorescent agents, perfumes, enzymes such as proteases and amylases, germicides and colourants.

The detergent compositions of the invention may take any of the common physical forms associated with fabric washing detergent compositions, such as powders, granules, cakes and liquids, but the present invention is of most benefit for detergent compositions in solid form, especially powders, as the drying step tends to encourage aggregation of the calcium carbonate which the presence of the dispersing aid is intended to overcome.

The present invention is illustrated by the following Examples in which parts and percentages are by weight.

EXAMPLE 1

A calcite slurry was prepared from non-dried calcite and had admixed with it an amount of bentonite in dilute aqueous dispersion. The treated calcite slurry was then admixed with other detergent ingredients and dried to form a detergent powder A. The same procedure was repeated with the absence of the bentonite to form a comparative powder B, with the formulations as follows:

| Ingredients | % A | % B |
|---|---|---|
| Sodium sec-linear alkyl ($C_{11}$–$C_{15}$) benzene sulphonate | 16 | 16 |
| Sodium carbonate | 32 | 32 |
| Calcite (Calofort U50)[1] | 30 | 30 |
| Bentonite (BDH) | 4 | — |
| Sodium sulphate | — | 4 |
| Sodium alkaline silicate | 8 | 8 |
| Sodium toluene sulphonate | 2 | 2 |
| Sodium carboxymethylcellulose | 0.3 | 0.3 |
| Water and other inorganic salts | 7.7 | 7.7 |

[1]As described in the dispersing aid test above.

These detergent compositions were then tested in RCA Whirpool washing machines for the formation of inorganic deposits on washed fabrics. It was found that under adverse washing conditions (full load of black cotton and cotton/polyester cloths, 0.25% product concentration, low water level and low wash temperature of 40°C, short wash cycle and cold rinse) the composition A had a significantly decreased tendency to form calcium carbonate deposits on the fabrics.

Alternative bentonite clays which may be used to similar effect are Wyoming bentonite, which is preferably sieved to exclude more coarse particles, Hectorite, saponites and synthetic laponites. Treated bentonite clays with increased or decreased swelling rates in water can be used but generally they are less effective than the natural untreated materials.

EXAMPLE 2

The procedure of Example 1 was repeated but the bentonite was added as a dry powder to the calcite slurry. In this case the resultant detergent composition again showed reduced calcium carbonate deposits on washed fabrics, but the improvement was not so marked as when using the bentonite pre-dispersed in water.

When the procedure was again repeated but using calcite which had been previously dried, there was only a marginal improvement in the calcium carbonate deposition properties of the resultant detergent composition.

EXAMPLE 3

The procedure of Example 1 was repeated but the calcite was treated with bentonite in aqueous dispersion and then dried before detergent slurry making. Again there was some improvement in the amount of deposition on washed fabrics compared with the use of untreated previously-dried calcite, though the effect was not so marked as when the calcite had not been dried prior to detergent slurry-making.

EXAMPLE 4

A calcite slurry was treated with bentonite (6.2% on the calcite) in aqueous dispersion and then dried. The treated calcite powder was then admixed with a spray dried detergent base powder to give a product of the following overall formulation:

| Ingredients | % |
|---|---|
| Sodium sec-linear alkyl ($C_{11}$–$C_{15}$) benzene sulphonate | 16 |
| Sodium carbonate | 30 |
| Sodium metasilicate | 5 |
| Calcite (Calofort U50) | 35 |
| Bentonite | 2.2 |
| Water (+ misc. salts etc.) | to 100 |

This product was evaluated and found to give low inorganic deposits on washed fabrics (black cloth grade 2) and to have good detergency properties. By way of comparison a product was made in the same manner but without the bentonite treatment, and this was found to give heavy deposots on fabrics washed under the same conditions.

What is claimed is:

1. A detergent composition comprising from about 5% to about 40% of a synthetic anionic, nonionic, amphoteric or zwitterionic detergent active compound, from about 10% to 75% of sodium or potassium carbonate detergency builder and from about 5% to about 60% of finely divided precipitated calcium carbonate prepared by passing carbon dioxide into a suspension of calcium hydroxide, said calcium carbonate having a surface area of from about 30 to about 100 square meters per gram ($m^2/g$) treated before drying with a water insoluble inorganic dispersing aid selected from the group consisting of natural montmorillonite-type clays and synthetic montmorillonite-type materials, in an amount of about 1% to about 50% by weight based on the weight of the calcium carbonate, said treated calcium carbonate having a decreased tendency to aggregation and deposition on washed fabrics.

2. A detergent composition according to claim 1, including from about 10% to about 25% by weight of the detergent active compound.

3. A detergent composition according to claim 1, including from about 20% to about 60% of sodium or potassium carbonate.

4. A detergent composition according to claim 1, including from about 10% to about 40% by weight of the finely divided calcium carbonate.

5. A detergent composition according to claim 1, wherein the calcium carbonate is calcite.

6. A detergent composition according to claim 1, wherein the calcium carbonate is treated with a natural montmorillonite clay.

7. A detergent composition according to claim 1, wherein the calcium carbonate is treated with about 5% to about 25% by weight of dispersing aid based on the weight of the calcium carbonate.

8. A detergent composition according to claim 1, including not more than about 0.5% by weight of sodium tripolyphosphate.

9. A detergent composition according to claim 1, wherein the detergent active compound is sodium linear secondary alkyl ($C_{10}$-$C_{15}$) benzene sulphonate.

10. A detergent composition according to claim 1, wherein the detergent active compound is sodium alkyl ($C_{10}$-$C_{18}$) sulphate.

11. A detergent composition according to claim 6, wherein the montmorillonite clay is bentonite.

12. A process for making a detergent composition in powder form according to claim 1, by forming an aqueous slurry of detergent ingredients and then spray drying the slurry to form the detergent powder, wherein the calcium carbonate is treated with the dispersing aid in aqueous suspension prior to detergent slurry making.

13. A process for making a detergent composition in powder form according to claim 1, by forming an aqueous slurry of detergent ingredients and then spray drying the slurry to form the detergent powder, wherein the calcium carbonate and the dispersion aid are separately added to the detergent slurry.

* * * * *